US007160262B2

(12) United States Patent
Wicks

(10) Patent No.: US 7,160,262 B2
(45) Date of Patent: Jan. 9, 2007

(54) BINDER

(76) Inventor: Trenna Ruston Wicks, 113 Ridgeview Park, Derry, PA (US) 15627

( * ) Notice: Subject to any disclaimer, the term of this patent is extended or adjusted under 35 U.S.C. 154(b) by 607 days.

(21) Appl. No.: 10/357,574

(22) Filed: Feb. 4, 2003

(65) Prior Publication Data

US 2005/0014451 A1 Jan. 20, 2005

Related U.S. Application Data

(60) Provisional application No. 60/354,644, filed on Feb. 6, 2002.

(51) Int. Cl.
*A61F 13/14* (2006.01)

(52) U.S. Cl. ..... 602/19; 602/5; 602/75; 602/76

(58) Field of Classification Search ..... 602/75, 602/19, 61, 5, 76; D24/191, 171
See application file for complete search history.

(56) References Cited

U.S. PATENT DOCUMENTS

| | | | | | |
|---|---|---|---|---|---|
| 3,570,480 | A * | 3/1971 | Stubbs | 602/19 |
| 3,598,114 | A * | 8/1971 | Lewis | 602/19 |
| 4,297,997 | A * | 11/1981 | Clayton | 604/19 |
| 4,802,667 | A * | 2/1989 | Altner | 482/93 |
| 5,302,171 | A * | 4/1994 | Pearson et al. | 602/19 |
| 5,399,151 | A * | 3/1995 | Smith | 602/19 |
| 5,591,122 | A * | 1/1997 | Yewer, Jr. | 602/19 |
| 5,860,945 | A * | 1/1999 | Cramer et al. | 602/62 |
| 5,897,518 | A * | 4/1999 | Shaw | 602/65 |
| 5,918,602 | A * | 7/1999 | Shaw et al. | 128/882 |
| 6,921,375 | B1 * | 7/2005 | Kihara | 602/5 |
| 2003/0050584 | A1 * | 3/2003 | Toda | 602/19 |

FOREIGN PATENT DOCUMENTS

GB 2095559 A * 10/1982

* cited by examiner

*Primary Examiner*—Tatyana Zalukaeva
*Assistant Examiner*—Keshia Gibson
(74) *Attorney, Agent, or Firm*—The Webb Law Firm

(57) ABSTRACT

A binder for supporting the abdomen, back, ribs or breasts includes an H-shaped elongated band with an inner surface and an outer surface. The H-shaped elongated band includes a central panel, a first extension member and second extension member extending from an upper portion of and contiguous with the central panel and a third extension member and a fourth extension member extending from a lower portion of and contiguous with the central panel. The inner surface of the central panel is positioned adjacent to a portion of a user's body and a first slit on the first extension member is adapted to receive the second extension member, and a second slit on the third extension member is adapted to receive the fourth extension member thereby securing the binder on the user's body via fastening members positioned on each of the extension members.

6 Claims, 5 Drawing Sheets

BINDER

CROSS-REFERENCE TO RELATED APPLICATION

This application claims the benefit of U.S. Provisional Application No. 60/354,644 on Feb. 6, 2002, which is hereby incorporated by reference.

BACKGROUND OF THE INVENTION

1. Field of the Invention

The present invention is related, in general, to supportive binders and, more particularly, to binders for supporting the abdomen, back, breasts or ribs.

2. Description of Related Art

Years ago, abdominal binders were commonly used after normal vaginal childbirth. In earlier, simpler times, the postpartum binder commonly used was called a Skultedus Binder. Nurses used old sheets to make them for each woman. The sheet would be folded into three or four layers about ten inches wide and centered on the patient's low back. Nurses would then tear three or four strips of the fabric horizontally on the sides, thereby leaving the back center piece intact. The torn tails were brought to the abdomen and crossed from right to left and left to right. Ends were pinned in place with a diaper pin. The binder was very comfortable and supportive; it offered welcome security to the new mother who was about to get out of bed and deal with her overstretched belly. Today's obstetrical health care providers miss them. Of course, our country's health care system has "progressed"; nurses no longer have time to tear sheets to fit individual patients and in fact, binders are rarely used after normal vaginal births.

In other situations, many pregnant women appreciate a maternity support that encircles, supports and girdles the pregnant belly. Some obese patients are not able to move about normally without significant support for their pendulous abdomens. Currently these patients may have only "girdles" which may not be large enough or comfortable enough to fit them. Maternity patients are limited to uncomfortable corsets or compressive supports that begin at the low back and swing down to fasten under the enlarged belly.

In still other situations, surgeons frequently order abdominal binders after abdominal surgery when there has been an incision of several inches or more. A current post-surgical binder is generally eight to twelve inches high from top to bottom and only the middle few inches of the binder fasten together. Such prior art post-surgical binders suffer from a lack of flexibility and non-conformity of the stiff elastic fabric from which they are formed. Furthermore, the top and bottom of the prior art post surgical binders are loose and non-functional as a support for the post-surgical belly, offering only 10 to 15% of potential and needed support.

Finally, just as a cast immobilizes a fractured bone and restricts movement which reduces pain, a binder can reduce pain in the spine or ribs. For low back pain, there are different varieties of binder designs that encircle the body in the area of the low back and pelvis and to reduce pain. Such devices are commonly suggested by physicians, physical therapists, and chiropractors to reduce motion. Some of these binders have optional inserts that slip in the back panel after they have been heated and molded to conform to the wearer's low back. Because they physically reduce motion via a tight fastening, they are girdle-like and uncomfortable.

Simple sitting causes so much upward pressure that the binder is often so uncomfortable that the patient must take the binder off.

Accordingly, a need exists for an abdominal binder that conforms to the appropriate section of the body and thereby provides support to the abdomen or stabilization to the spine and pelvis. A further need exists for an abdominal binder that is comfortable to wear while also providing motion reduction to the abdomen, spine and pelvis.

SUMMARY OF THE INVENTION

The present invention is directed to a binder for supporting the abdomen, back, ribs or breasts. The binder includes an H-shaped elongated band with an inner surface and an outer surface. The H-shaped elongated band includes a central panel, a first extension member and second extension member extending from an upper portion of and contiguous with the central panel and a third extension member and a fourth extension member extending from a lower portion of and contiguous with the central panel. The first extension member includes a first fastening member positioned at an end thereof on the inner surface of the elongated band and a first slit positioned adjacent to the fastening member. The second extension member includes a second fastening member positioned at an end thereof on the inner surface of the elongated band. The third extension member includes a third fastening member positioned at an end thereof on the inner surface of the elongated band and a second slit positioned adjacent to the fastening member. The fourth extension member includes a fourth fastening member positioned at an end thereof on the inner surface of the elongated band. The first, second, third and fourth extension members each have an approximately equal width and length. The outer surface of the elongated band is constructed from a material adapted to secure the first, second, third and fourth fastening members. In use, the inner surface of the central panel is positioned adjacent to a portion of a user's body and the first slit on the first extension member is adapted to receive the second extension member, and the second slit on the third extension member is adapted to receive the fourth extension thereby securing the binder on the user's body. The binder may be constructed from an elastic material.

The central panel may have a width of about 8 inches and a length of at least about 10 inches, for example about 10 inches to about 24 inches. The first, second, third and fourth extension members may have a length that ranges from about 10 inches to about 30 inches and a width of about 4 inches.

The first, second, third and fourth fastening members may be pieces of hook fabric. The material from which the outer surface of the elongated body is constructed is a loop fabric that is compatible with the hook fabric of the fastening members. The hook fabric is desirably VELCRO, a hook-and-loop fastener. The first, second, third and fourth fastening members may be adapted to be fastened to any portion of the outer surface of the elongated band.

These and other features and characteristics of the present invention will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION OF THE INVENTION

The present invention is a binder that conforms to an appropriate section of the body and thereby provides support to the abdomen or stabilization to the spine and pelvis, ribs or breasts. The binder of the present invention is also comfortable to wear and provides motion reduction to the abdomen, spine and pelvis, ribs or breasts.

Figure 1:
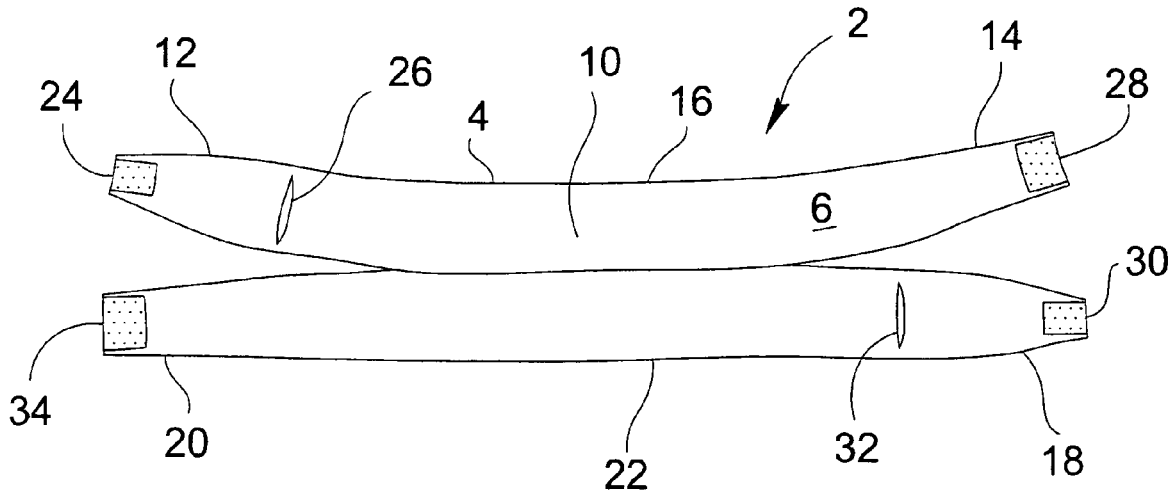
FIG. 1 is a top plan view of a binder in accordance with the present invention.
Figure 2:
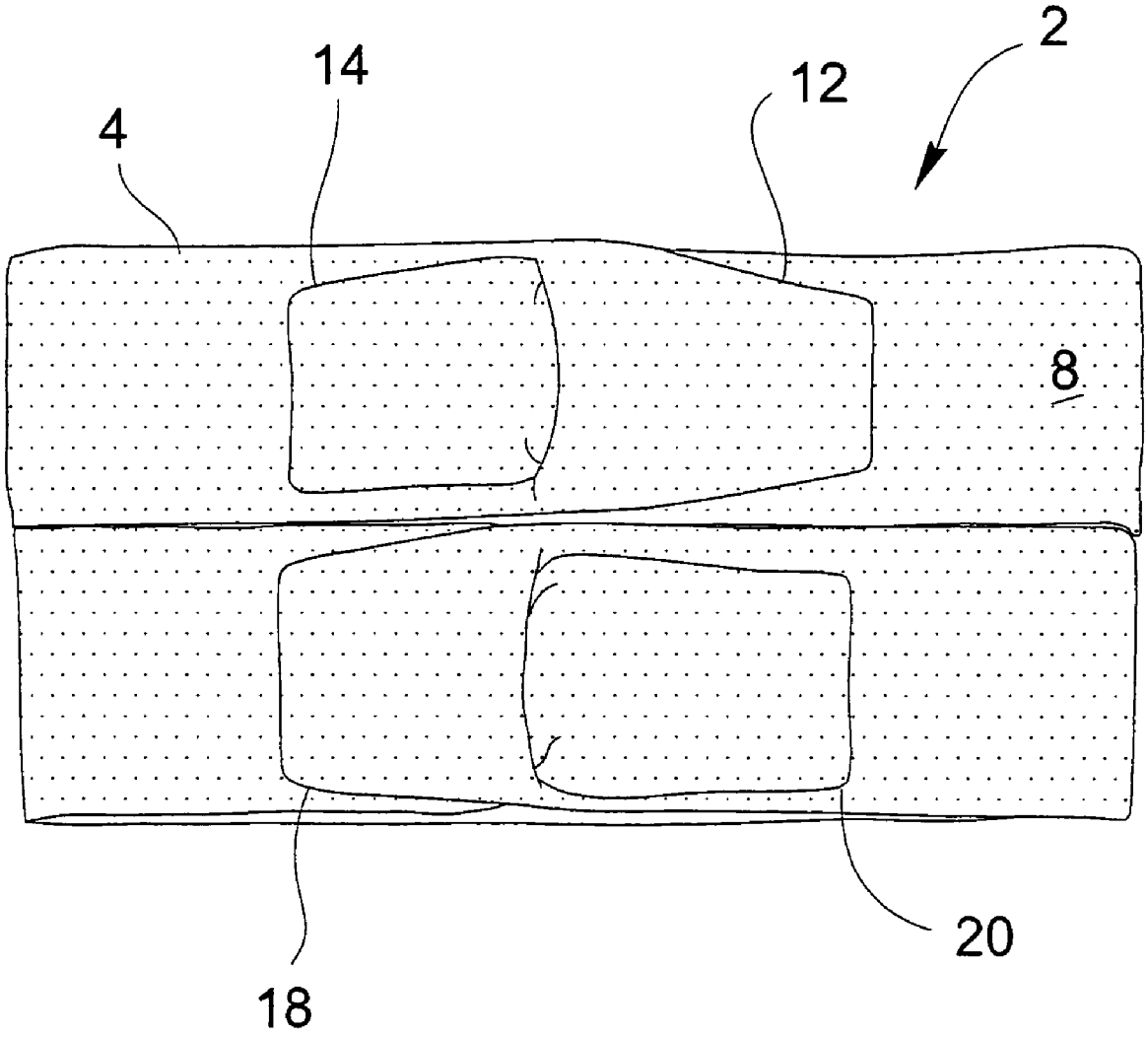
FIG. 2 is a top plan view of the binder of FIG. 1 in a fastened position.

With reference to FIGS. 1 and 2, a binder, generally denoted by reference numeral 2, includes an H-shaped elongated band 4 with an inner surface 6 and an outer surface 8. H-shaped elongated band 4 includes a central panel 10, a first extension member 12 and second extension member 14 extending from an upper portion 16 of and contiguous with central panel 10. H-shaped elongated band 4 also includes a third extension member 18 and a fourth extension member 20 extending from a lower portion 22 of and contiguous with central panel 10.

First extension member 12 includes a first fastening member 24 positioned at an end thereof on inner surface 6 of elongated band 4 and a first slit 26 positioned adjacent to first fastening member 24. Second extension member 14 includes a second fastening member 28 positioned at an end thereof on inner surface 6 of elongated band 4. Third extension member 18 includes a third fastening member 30 positioned at an end thereof on inner surface 6 of elongated band 4 and a second slit 32 positioned adjacent to third fastening member 30. Fourth extension member 20 includes a fourth fastening member 34 positioned at an end thereof on inner surface 6 of elongated band 4.

First, second, third and fourth extension members 12, 14, 18 and 20, respectively, each have an approximately equal width and length. The length of first, second, third and fourth extension members 12, 14, 18, 20 may range from about 10 inches to about 30 inches and the width of first, second, third and fourth extension members 12, 14, 18 and 20, respectively, is about four inches. Central panel 10 has a width of about 8 inches and a length of at least about 10 inches.

First, second, third and fourth fastening members 24, 28, 30 and 34, respectively, may be pieces of hook fabric. The hook fabric is desirably VELCRO, a hook-and-loop fastener. The pieces of hook fabric may have a length that ranges from about 1 inch to about 3 inches.

Binder 2 may be constructed from an elastic material or a breathable, non-slip, laminated urethane fabric. An example of such a material is disclosed in U.S. Pat. No. 5,036,838 to Sherman, which is hereby incorporated by reference in its entirety. The material used to construct binder 2 is strong and soft. Such features allow the binder to conform to the contour of individual bodies. The result is a firm but soft, comfortable, supportive and non-constricting compressive force. Outer surface 8 of elongated band 4 of binder 2 is constructed from a material adapted to secure first, second, third and fourth fastening members 24, 28, 30 and 34, respectively. The material from which outer surface 8 of elongated body 4 is constructed is a loop fabric that is compatible with the hook fabric of fastening members 24, 28, 30 and 34. The first, second, third and fourth fastening members 24, 28, 30 and 34, respectively, may be adapted to be fastened to any portion of outer surface 8 of elongated band 4.

Figure 3:
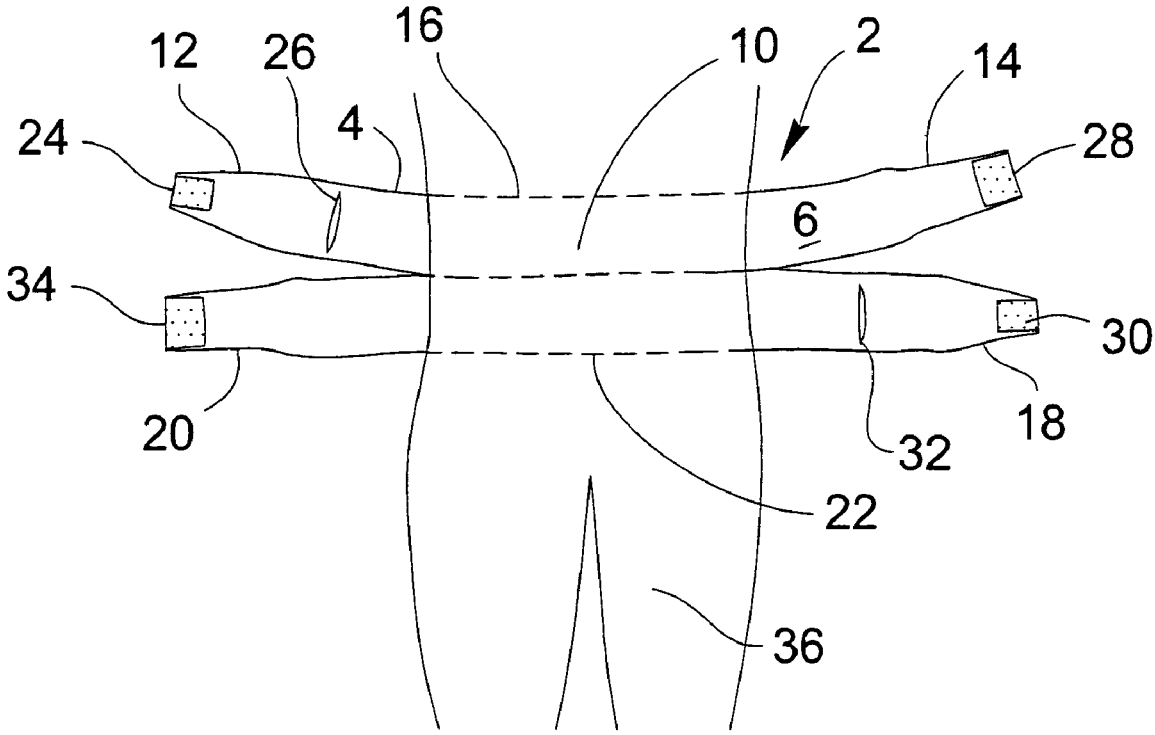
FIG. 3 is a side plan view of the side of a user with the binder of FIG. 1 positioned on the side of the user.
Figure 4:
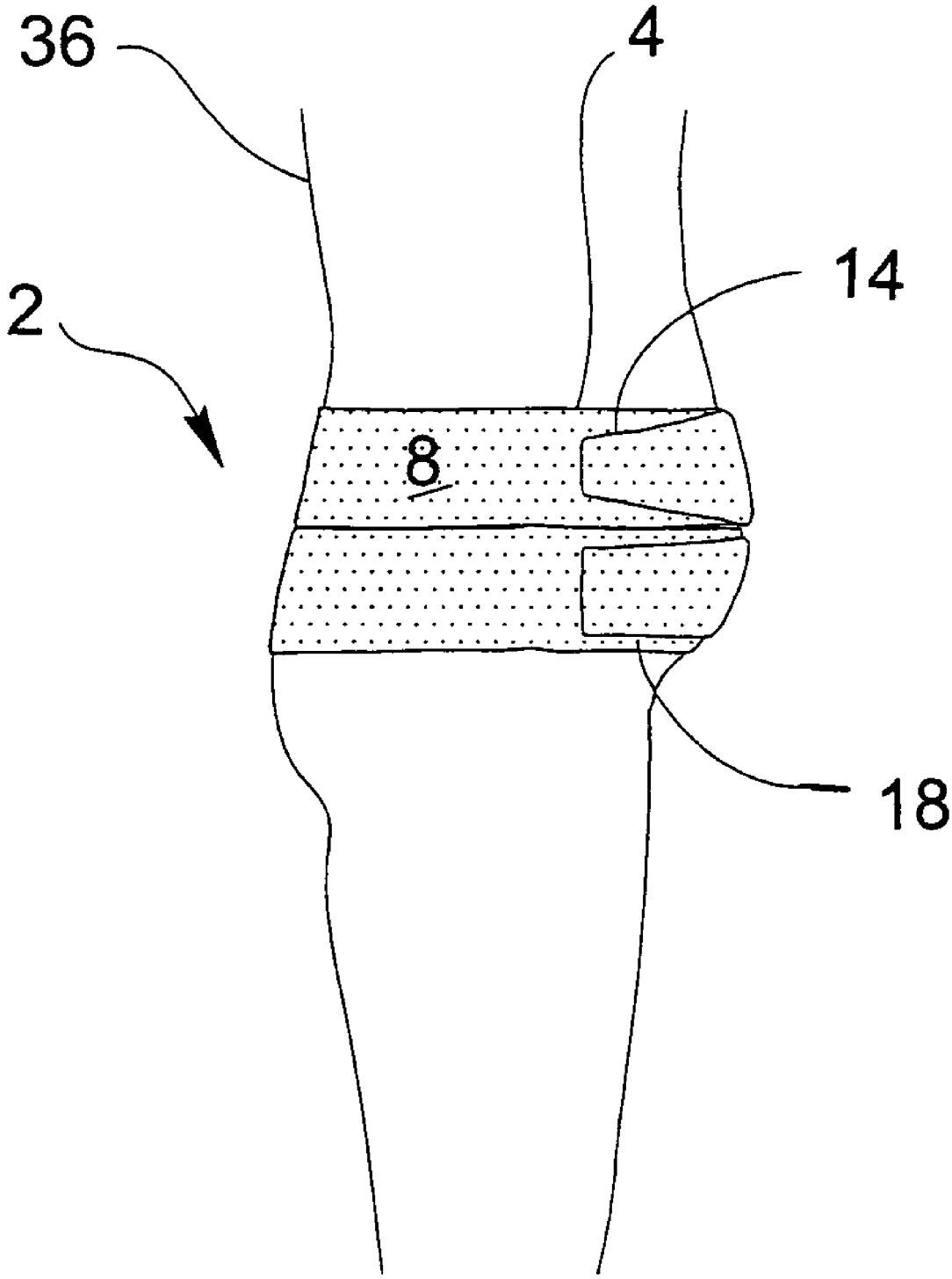
FIG. 4 is a side plan view of the side of a user with the binder of FIG. 1 secured thereto.
Figure 5:
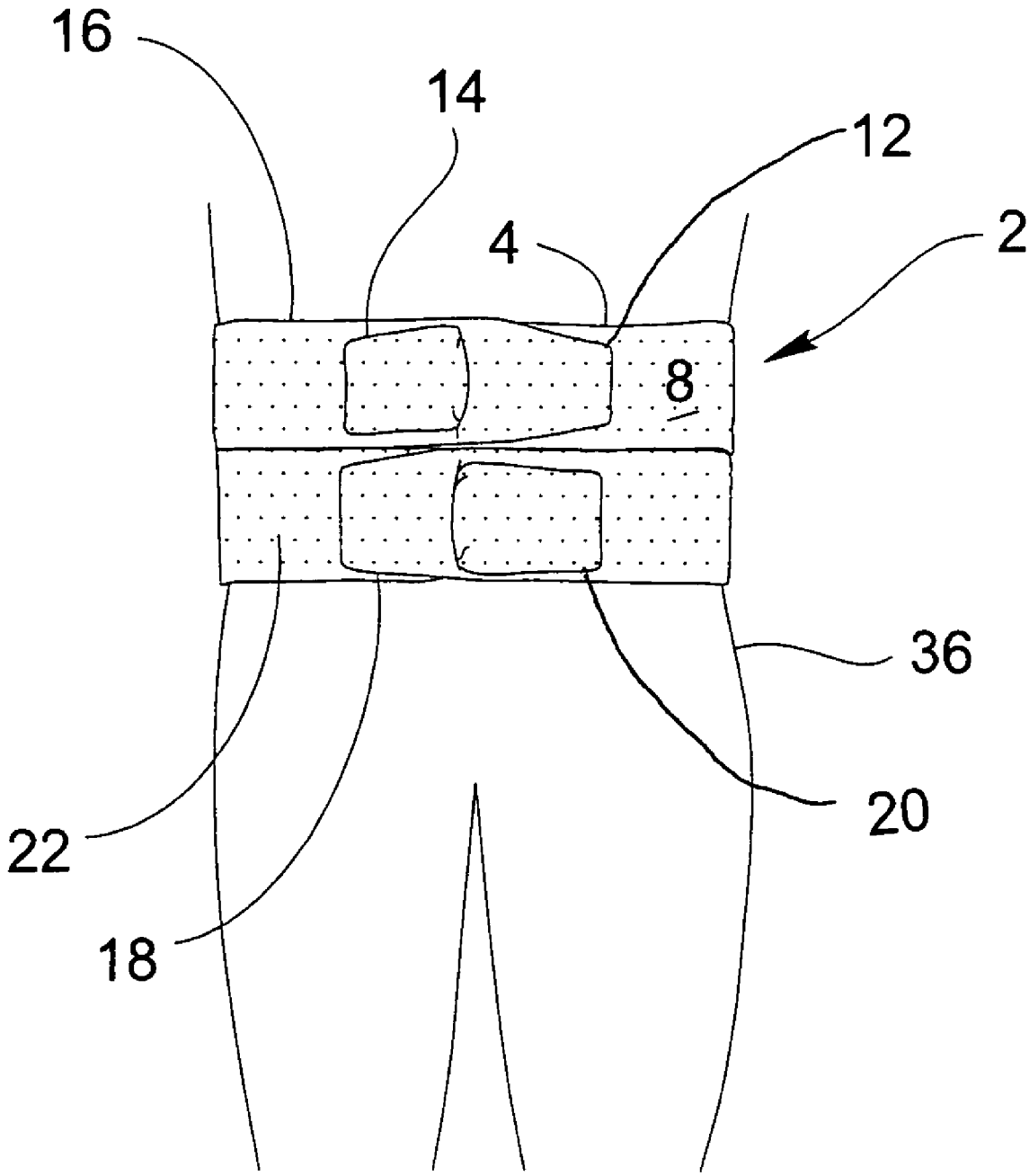
FIG. 5 is a side plan view of the back of a user with the binder of FIG. 1 secured thereto.

With reference to FIGS. 3–5 and with continuing reference to FIGS. 1 and 2, in use, inner surface 6 of central panel 10 is positioned adjacent to a portion of a user's body 36 at an appropriate level to support or stabilize a target area of the body 36, such as, but not limited to the spine, pelvis, ribs, breasts or abdomen. The user or an assistant, if the user is unable, pulls second extension member 14 forward and through first slit 26 in first extension member 12. Second extension member 14 is then fastened via second fastening member 28 to outer surface 8 of elongated body 4, and first extension member 12 is fastened via first fastening member 24 to outer surface 8 of elongated body 4 at a position opposite second extension member 14 as shown in FIGS. 2 and 4. Similarly, the user or the assistant pulls fourth extension member 20 forward and through second slit 32 in third extension member 18. Fourth extension member 20 is then fastened via fourth fastening member 34 to outer surface 8 of elongated body 4, and third extension member 18 is fastened via third fastening member 30 to outer surface 8 of elongated body 4 at a position opposite second extension member 14 as shown in FIGS. 2 and 4. Tightness is variable according to the purpose of binder 2; patient's condition and preference; and the healthcare provider's direction. The position of the binder may also vary depending on the purpose for which the binder is being used. To stabilize the low back or lumber spine, center panel 10 is placed over the whole of the user's lower back. To stabilize the upper back or ribs, placement of central panel 10 would be higher. To stabilize the sacroiliac joints, the initial placement of the central panel 10 would be lower.

Binder 2 of the present invention may be used in a variety of manners within the medical arena. For example uses of binder 2 include, but are not limited to, conforming to the belly and offer support to the organs and muscles after abdominal surgery; encircling, supporting and girdling a slackened belly after childbirth; encircling, supporting and girdling a pregnant belly of a female or an obese belly of child or adult, male or female; reducing motion and thereby stabilizing the joints of the upper back, low back, breasts, ribs and/or pelvis; reducing the motion of a fracture; and easing breast discomfort when breast-feeding must be discontinued.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A binder comprising:

an H-shaped elongated band with an inner surface and an outer surface, the H-shaped elongated band comprising:

a central panel;

a first extension member and second extension member extending from an upper portion of and contiguous with the central panel, the first extension member comprising a first fastening member positioned at an end thereof on the inner surface of the elongated band and a first slit positioned adjacent to the first fastening member, and the second extension member comprising a second fastening member positioned at an end thereof on the inner surface of the elongated band; and a third extension member and a fourth extension member extending from a lower portion of and contiguous with the central panel, the third extension member comprising a third fastening member positioned at an end thereof on the inner surface of the elongated band and a second slit positioned adjacent to the third fastening member, the fourth extension member comprising a fourth fastening member positioned at an end thereof on the inner surface of the elongated band, the first, second, third and fourth extension members each having an approximately equal width and length, and the outer surface of the elongated band constructed from a material adapted to secure the first, second, third and fourth fastening members, wherein the first, second, third and fourth fastening members are pieces of hook fabric, and the material from which the outer surface of the elongated body is constructed is a loop fabric that is compatible with the hook fabric of the fastening members;

wherein the inner surface of the central panel is positioned adjacent to a portion of a user's body and the first slit on the first extension member is adapted to receive the second extension member and the second slit on the third extension member is adapted to receive the fourth extension thereby securing the binder on the user's body with the end of the first extension member and the end of the third extension member pointing in opposite directions.

2. The binder of claim 1, wherein the elongated body is constructed from an elastic fabric.

3. The binder of claim 1, wherein the central panel has a width of about 8 inches and a length of at least about 10 inches.

4. The binder of claim 1, wherein the first, second, third and fourth extension members have a length that ranges from about 10 inches to about 30 inches.

5. The binder of claim 1, wherein the first, second, third and fourth extension members have a width of about four inches.

6. The binder of claim 1, wherein the first, second, third and fourth fastening members are adapted to be fastened to any portion of the outer surface of the elongated band.

* * * * *